US009045912B2

(12) United States Patent
Fearn

(10) Patent No.: US 9,045,912 B2
(45) Date of Patent: Jun. 2, 2015

(54) WALER STRONGBACK CLAMP WITH CAM

(71) Applicant: Richard N. Fearn, Delta (CA)

(72) Inventor: Richard N. Fearn, Delta (CA)

( * ) Notice: Subject to any disclaimer, the term of this patent is extended or adjusted under 35 U.S.C. 154(b) by 0 days.

(21) Appl. No.: 14/027,887

(22) Filed: Sep. 16, 2013

(65) Prior Publication Data

US 2014/0166849 A1 Jun. 19, 2014

Related U.S. Application Data

(60) Provisional application No. 61/701,640, filed on Sep. 15, 2012.

(51) Int. Cl.
*E04G 17/02* (2006.01)
*E04G 17/14* (2006.01)

(52) U.S. Cl.
CPC ..... *E04G 17/02* (2013.01); *E04G 17/14* (2013.01)

(58) Field of Classification Search
CPC ..... E04G 17/02; E04G 17/04; E04G 17/14
USPC ..... 249/219.1, 219.2
See application file for complete search history.

(56) References Cited

U.S. PATENT DOCUMENTS

| | | | | | |
|---|---|---|---|---|---|
| 1,509,835 | A * | 9/1924 | Grossenbach | ..... | 403/387 |
| 2,133,574 | A * | 10/1938 | Roemisch | ..... | 249/213 |
| 2,967,689 | A * | 1/1961 | Jahn | ..... | 248/205.1 |
| 3,175,797 | A * | 3/1965 | Wells | ..... | 249/188 |
| 3,429,548 | A * | 2/1969 | Taylor | ..... | 249/192 |
| 4,003,546 | A * | 1/1977 | Johnson | ..... | 249/219.2 |
| 4,054,259 | A * | 10/1977 | Johnson | ..... | 249/219.2 |
| 4,304,388 | A * | 12/1981 | Gates | ..... | 249/219.2 |
| 4,643,388 | A * | 2/1987 | Tazawa | ..... | 249/219.2 |
| 6,254,056 | B1 * | 7/2001 | Alfred | ..... | 249/219.1 |

* cited by examiner

*Primary Examiner* — Michael Safavi

(57) ABSTRACT

A waler and strongback bracket used clamp a waler and strongback to the face of a concrete wall form. The bracket consists of a metal body with a vertical surface for attachment to the wall form, a horizontal surface for supporting the waler, a vertical surface for the strongback and a cam that when rotated locks both the waler and strongback against the concrete wall form.

7 Claims, 6 Drawing Sheets

WALER STRONGBACK CLAMP WITH CAM

CROSS REFERENCE TO RELATED APPLICATIONS

This application claims priority under 35 U.S.C 119(e) to Richard Fearn's U.S. Provisional Patent Application No. 61/701,640 filed on Sep. 15, 2012 entitled INSULATING CONCRETE FORM WALER BRACKET WITH CAM, the disclosure of which is incorporated herein by reference.

FIELD OF THE INVENTION

This invention relates generally to an alignment apparatus for concrete wall forms which aligns the wall in both the horizontal and vertical directions. This apparatus is restricted to those wall forms where the hydraulic concrete pressures are taken by the wall form itself, for example with insulating concrete forms.

DISCUSSION OF RELATED ART

Wall forming systems for concrete have been in use for many years, and generally have consisted of plywood panels with steel ties to restrain the panels parallel to each other the wall distance apart. Then 2×4 horizontal walers align the plywood panels horizontally. Waler brackets are used to clamp the 2×4 against the panel.

There are three categories of waler brackets. The first category is where the waler bracket both align the wall and lock on to the end of the steel tie to restrain the hydraulic pressures of the concrete. For example:

| | | |
|---|---|---|
| Jahn | 2,967,689 | January 1961 |
| Gates | 3,018,538 | January 1962 |
| Kay | 3,128,525 | April 1964 |
| Jahn | 3,216,690 | November 1965 |
| Gates | 3,363,877 | January 1968 |
| Kirby | 3,589,666 | June 1971 |
| Alfred | 6,254,056 | July 2001 |

While these inventions effectively clamp the horizontal waler to align the plywood panels in the horizontal direction, they do not align the forms in the vertical direction.

The second category of waler bracket is where a vertical member called a strongback (2×4) clamped to the outside of the horizontal walers to give alignment vertically. The combination of the vertical and horizontal members ensures the wall is flat in both directions. There are three inventions which specifically address the horizontal and vertical alignment of concrete wall forms:

| | | |
|---|---|---|
| Johnson | 4,054,259 | October 1977 |
| Gates | 4,304,388 | December 1981 |
| Boeshart | 4,791,767 | December 1988 |

Johnson's invention effectively takes the waler bracket and additions an "anchor rod structure" which anchors the strongback to the outside of the waler bracket. A cam lever, in combination with rod-like arms is installed along with the strongback after the waler bracket is in position. However this method is cumbersome and labor intensive.

Gates invention is similar to Johnsons; however it uses a locking cam to tighten on the end of the concrete tie. Again a cam lever in combination with a wire bail is used to tighten the strongback to the waler bracket. Again this invention is cumbersome and labor intensive.

Boesharts invention will be discussed subsequently.

The third category of waler brackets is where the waler bracket is only used to align the wall form, it does not restrain the concrete pressure. For example Titcombs invention U.S. Pat. No. 7,066,440 June 2006 is used to align 1⅛" plywood forms where they have proprietary steel ties. However this invention does not align the wall in the vertical direction. Similarly Holmboe's invention U.S. Pat. No. 6,322,047 November 2001 does not restrain the concrete pressure; however his invention does not align the wall in the vertical direction. Boeshart's invention also does not restrain the concrete pressure and will be discussed subsequently.

In recent years, because of energy conservation, insulating concrete forms (ICFs) have been developed. These forms have the plywood panels replaced with insulation (typically expanded polystyrene). To restrain the concrete pressures, they incorporated plastic webs which are molded into the insulation panels. As the foam panels are soft and flexible, proper alignment both in the horizontal and vertical direction is very important. As the concrete hydration process is exothermic (giving off heat) the forms soften even more and the alignment system is critical to obtaining a flat and true concrete wall.

To ensure proper alignment, the industry has developed steel or aluminum braces which consist of 'U'-shaped beams about three inches square and ten feet high which are screw attached to the plastic ties of the ICF forms approximately five or six feet on center. Then kickers with turnbuckles are used to align each beam in the plumb position. There are several disadvantages with this system: first, each brace (beam and kicker) weights about 65 pounds, therefore the total weight is about 2,600 pounds for a typical foundation. Secondly, the system first braces vertically, and uses the turnbuckle to align horizontally. However it is of primary importance to align horizontally so that the top edge of the concrete wall is straight and true. Thirdly, the vertical braces along the face of the wall prevent scabbing any members horizontally to reinforce windows or end of wall bucks. Fourthly, the method has difficulty adapting top uneven wall heights as the beams are typically all the same length. Finally the system is expensive, which each brace costing about $250, or $10,000 for a typical foundation.

Boeshart's invention U.S. Pat. No. 4,791,767 was designed specifically for ICFs. It consists of a clamp which consists of a sheet metal angle screw attached to two webs of the ICF block. The horizontal waler (2×4 or I-joist) is placed on top of this angle. A cam lever is used to hold the waler from above. On the outside a sheet metal flange is attached with a pair of bolts and wing nuts through a slot to hold the waler snuggly against the angle iron. This method of holding the horizontal waler is complex with many parts and very labor intensive to install and strip after the pour. While the invention does indicate a vertical strong back; no description is given on how this "tong-clamp" will work. As a lineal foot of an 8" thick concrete wall 10 feet tall weighs 1,000 pounds, it is extremely important that vertical alignment is dealt with. However this invention does not make any claims on the vertical alignment.

SUMMARY OF THE INVENTION

This waler strongback clamp with cam according to the invention consists of a 10 gauge sheet metal body having three faces: a vertical face approximately 2 inches wide and 7 inches tall with holes top and bottom for screw attaching to the plastic web of the ICF block. A horizontal face protrudes from the centre of the vertical face about 3" which provides a saddle for the horizontal 2×4 waler. A third face, running vertically, joins the other two faces on their left edge and extends about 8" past the first vertical face. Near the end of the third face is a hole into which a shoulder bolt and plastic cam is attached. When the cam is in the 'open' position, a vertical 2×4, called the strongback, is placed between the cam and the horizontal waler.

As the cam is rotated counter clock wise by hand, the radius is increased so that the surface of the cam tightens on the strongback and subsequently on the waler. At the same time, the outside edge or lip of the cam increases by one half inch in diameter, thereby preventing the strongback from sliding off the cam.

The invention reduces the difficulties and disadvantages of the prior art by providing a waler-strongback bracket which is light weight, easy to install and less expensive. The waler-strongback clamp with cam weights only 1.8 pounds which is more than 40 times lighter than the conventional ICF vertical brace. As well, the clamp is less than one tenth the cost of the conventional ICF brace.

BRIEF DESCRIPTION OF THE DRAWINGS

While some of the advantages of the present invention have been set forth above, other advantages will become apparent from the description of the preferred embodiment of this invention when taken in conjunction with the accompanying drawings, in which.

DETAILED DESCRIPTION OF THE PREFERRED EMBODIMENT

Figure 1:
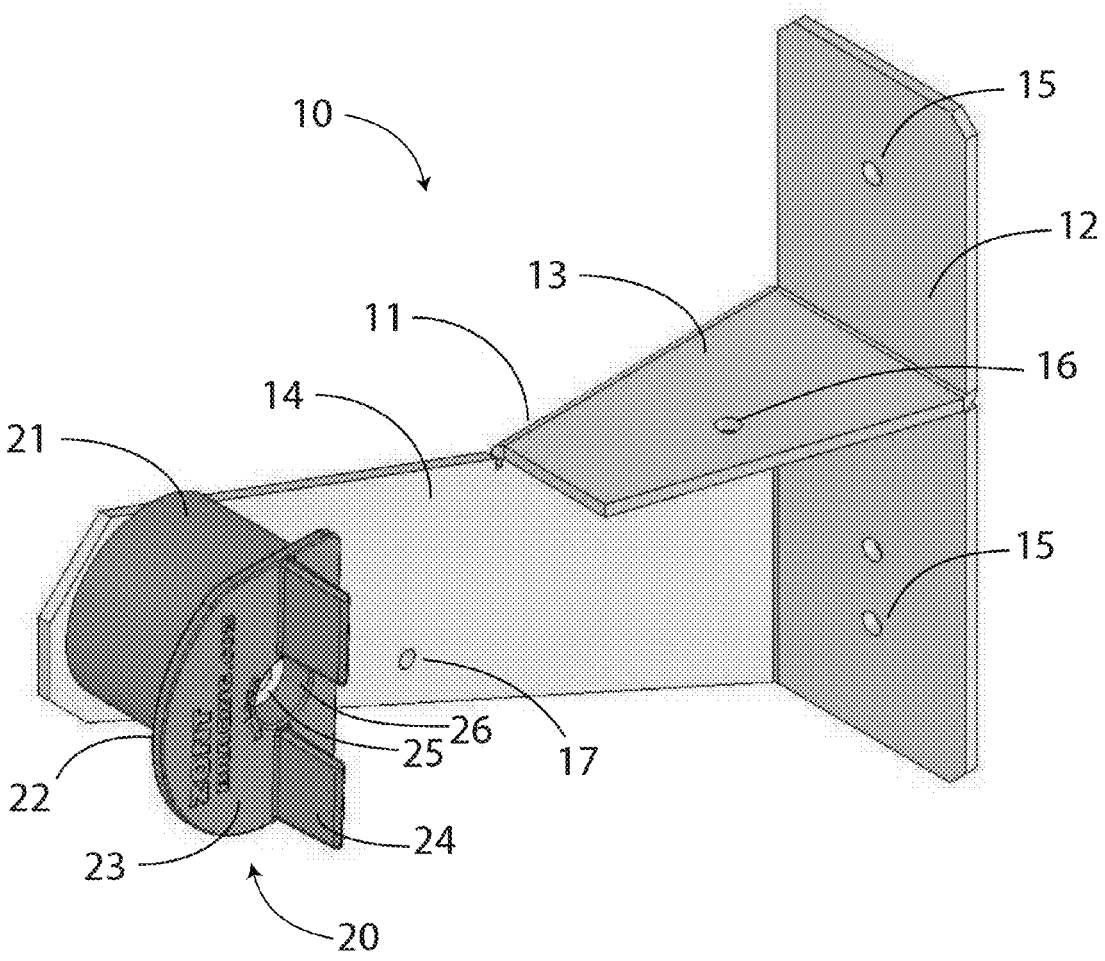
FIG. 1 is a simplified perspective view of the waler strongback clamp with cam.

FIG. 1 is a simplified perspective view showing the preferred embodiment of the waler strongback clamp with cam (10). It consists of a body (11) made from 10 gauge sheet metal, a plastic cam (20) and a shoulder bolt (25) attaching cam to body (11).

The clamp body (11) consists of a substantially vertical member (12), a substantially horizontal member (13) extending from approximately the midpoint of vertical member (12), and a second vertical member (14) extending from and perpendicular to both the vertical member (12) and horizontal member (13). This second vertical member (14) extends a distance past horizontal member (13). A hole is located at the end of the second vertical member (14) away from the vertical member (10), so that a cam (20) is attached using a shoulder bolt (25) and nut. Typically the body (11) would be made from a single piece of sheet metal, bent at 90 degrees to produce the shape as shown in FIG. 1.

Figure 2:
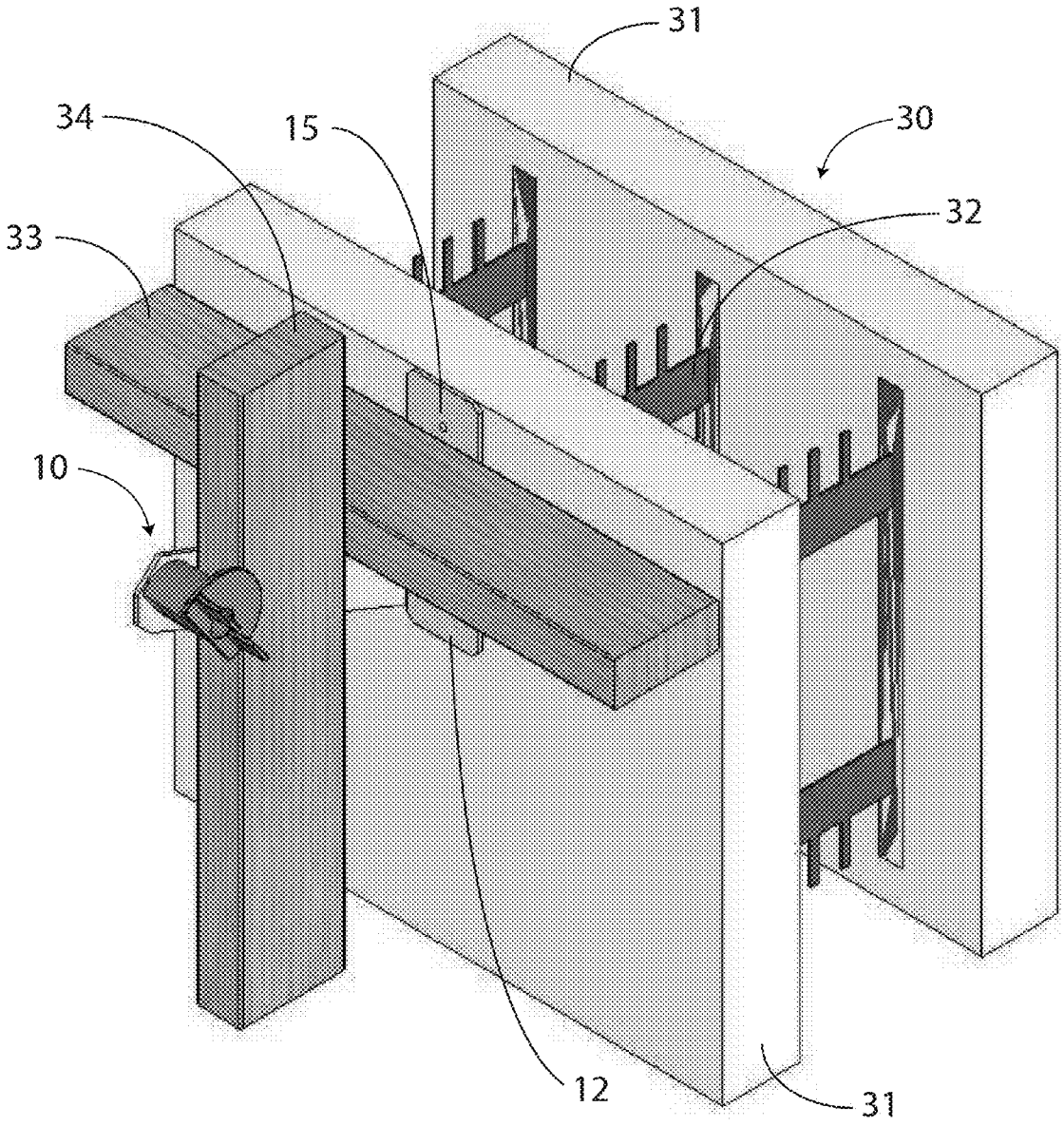
FIG. 2 is a simplified perspective view of the waler strongback clamp showing also the waler, strongback and concrete form.

FIG. 2 is a simplified perspective view showing the preferred embodiment of the waler strongback clamp (10) in combination with a waler (33), strongback (34) and concrete form (30). The concrete form consists of two panels (31) 48 inches in length, 16 inches in height and each of a thickness of 2.5 inches. They are spaced apart the thickness of the desired concrete wall thickness, usually 6 or 8 inches. The panels are normally made of expanded polystyrene to provide insulation value to the concrete wall. To hold the panels the required distance apart, plastic or steel ties (32) are molded into the panels (31) during the manufacturing process. These forms are called "ICFs" or "insulated concrete forms" in the industry.

As the panels are made from light weight foam, they are flexible and need to be properly braced to prevent movement both before and during the concrete pour. This can be achieved by attaching horizontal lineal members (33) called "walers" which are attached to the side of the concrete form (30) to provide sufficient rigidity to the foam forms. The walers are typically 2×4s made from lumber, but they can also be made from steel studs. In order to align the wall vertically, vertical lineal members (34) called "strongbacks" are clamped to the outside of the walers (33). These vertical members are typically 2×4s made from lumber.

The clamp (10) is used to clamp the walers and strongbacks against the face of the foam panel as shown in FIG. 2. The clamp (10) is screwed to the side of the panel using holes (15) on the vertical face (12) and attaching into the ties (32) for strength, as the foam cannot support the load from the screws. The waler (33) is supported by the horizontal flange (13) and the strongback (34) is located beside the waler adjacent to the second vertical flange (14). The hole (16) can be used to screw attach the waler to the flange is desired. The hole (17) can be used to attach the strongback to the right side of the second vertical flange (14).

The cam (20) is located at the end of the vertical face (14) so that both the waler and strongback can be inserted between the vertical face (12) and the cam. As the cam's surface (21) has different radii around the circumference, by rotating the cam the waler and strongback can be clamped in position. As the clamp (10) is screwed to the side of the ICF form, the waler and strongback are effectively clamped to the side of the ICF thereby providing the rigidity and flatness required to the concrete formwork.

Figure 3:
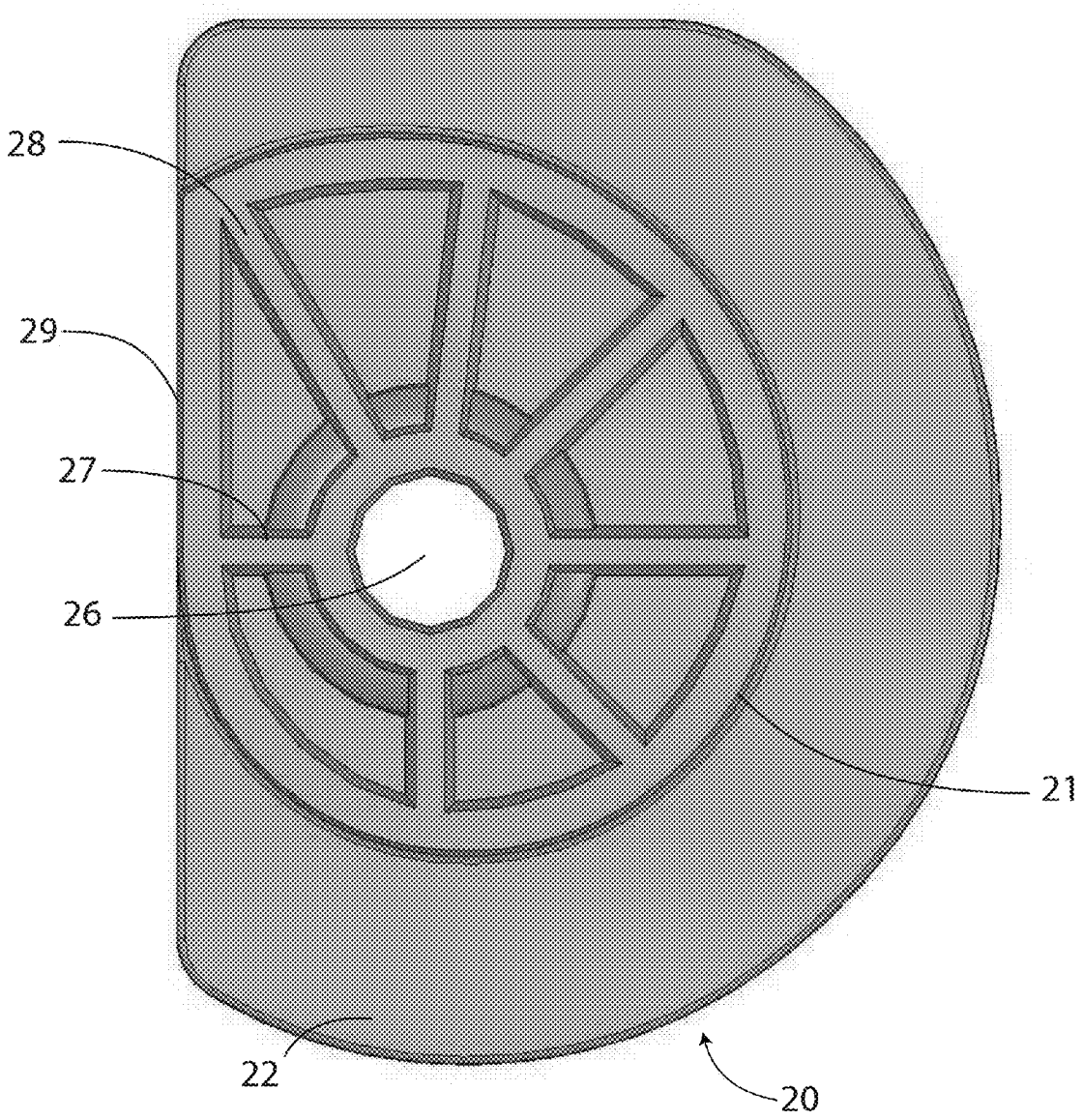
FIG. 3 is a rear view of the cam showing the change in radius around the circumference of the cam.

FIGS. 1 and 3 provide details on the design and molding of the plastic cam (20). Typically the cam would be injection molded to obtain the desired shape and contour. The cam has an axis running horizontally as shown in FIG. 1. The outside face (23) has two protrusions or handles 24 which allow the installer to rotate the cam around the axis as required. A shoulder bolt (25) is located on the axis 26 of the cam, allowing the cam to rotate, while holding the cam in position against the second vertical face (14). The outside face of the cam (21) has a lip (22) which extends past the cam face (23) about one half inch for most of the circumference. The cam has a point where the radius is shortest (27) and a location where the radius is longest (28). Between these two points is an area (29) where the outside face (23) is flat. There is no lip (22) at this flat area which allows the strongback to be placed between the cam and waler. Plastic ribs (27, 28) reinforce the interior of the cam (20) as shown in FIG. 3.

Figure 4:
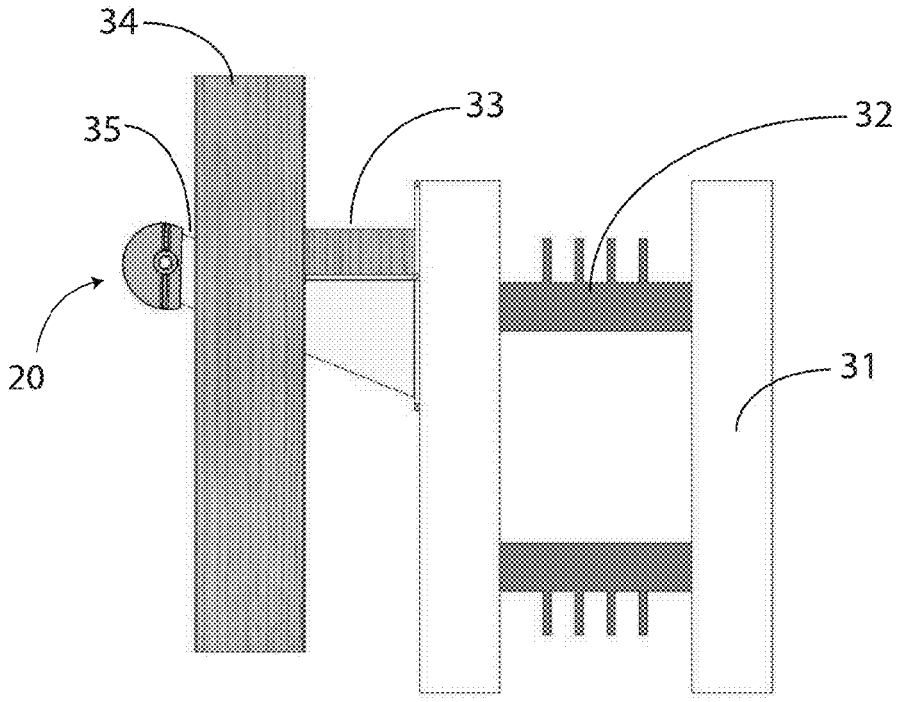
FIG. 4 is a side view of the waler strongback clamp showing the cam in the open position.
Figure 5:
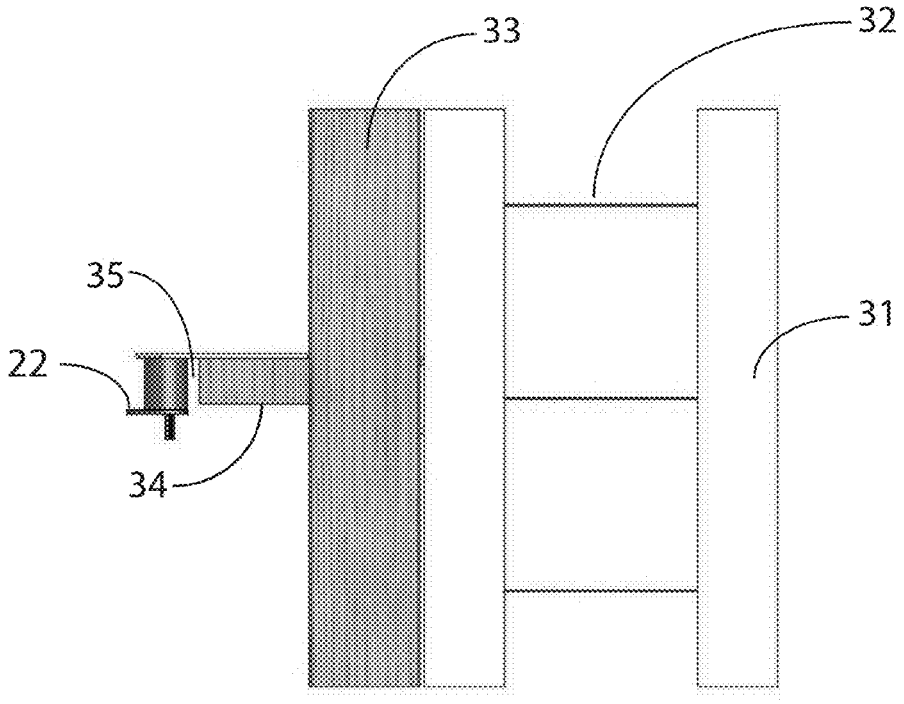
FIG. 5 is a top view of the waler strongback clamp showing the cam in the open position.

FIGS. 4, 5, 6 and 7 show the cam both before and after locking the waler and strongback in position. FIG. 4 shows a side elevation along the axis of the cam and concrete form. The cam (20) is shown in the "open" position with the flat face (29) parallel and close to the strongback. It can be seen that there is a space (35) which allows the strongback (34) to be inserted between the waler (33) and cam (20). FIG. 5 shows FIG. 4 from a vertical view.

Figure 6:
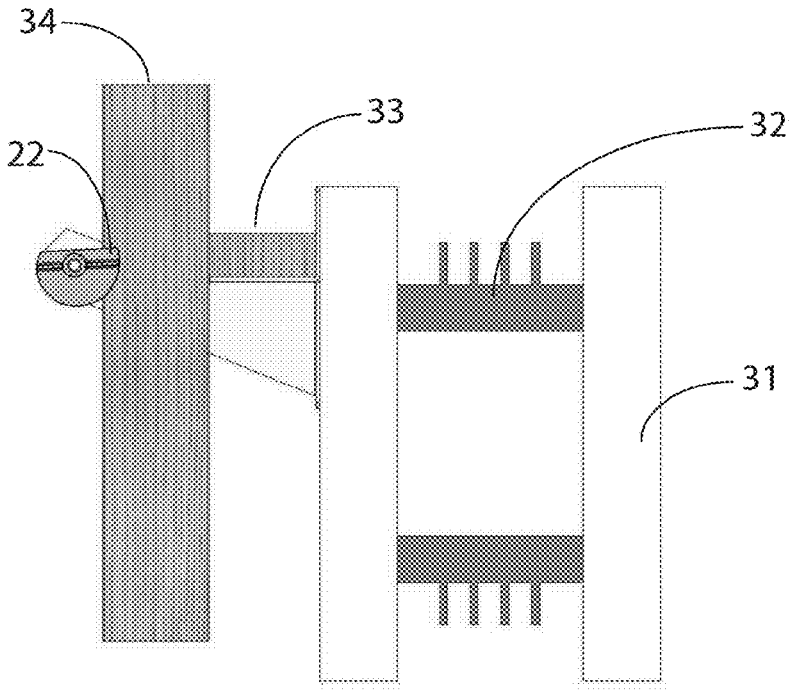
FIG. 6 is a side view of the waler strongback clamp showing the cam in the locked position.
Figure 7:
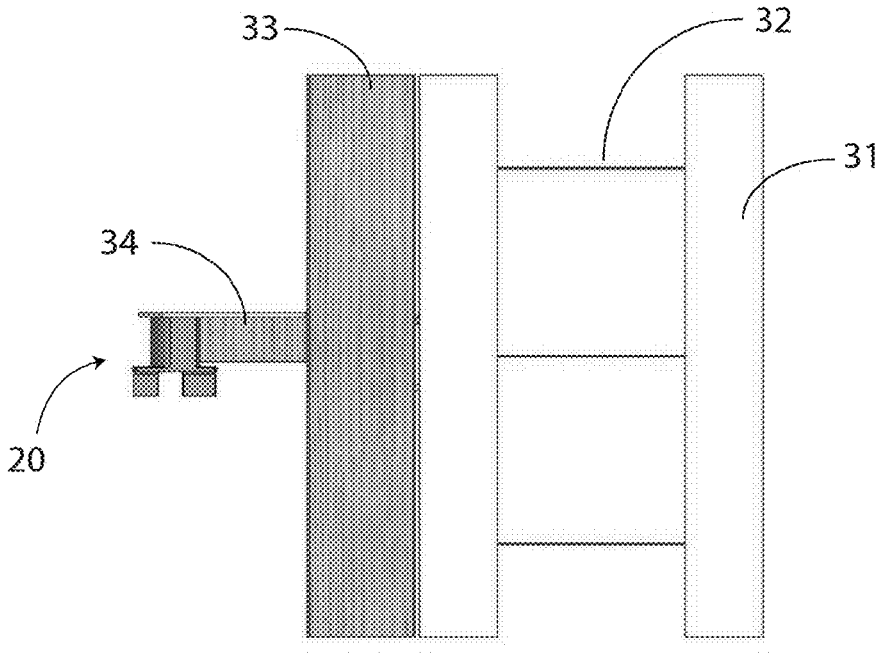
FIG. 7 is a top view of the waler strongback clamp showing the cam in the locked position.

In FIGS. 6 and 7 the cam has been rotated in a counter clockwise direction so that the radius of the cam surface is increasing. FIG. 6 is a side elevation, FIG. 7 a top elevation. The cam is rotated until the strongback and waler are locked between the cam surface (21) and the vertical surface (12). The rotation also engages the lip (22) so that the strongback can not move away from the vertical surface (14). The cam shape is such that the difference in radius divided by the difference in distance around the circumference is between 2 and 8 percent. This shallow slope prevents the cam from slipping back on its axis.

Figure 8:
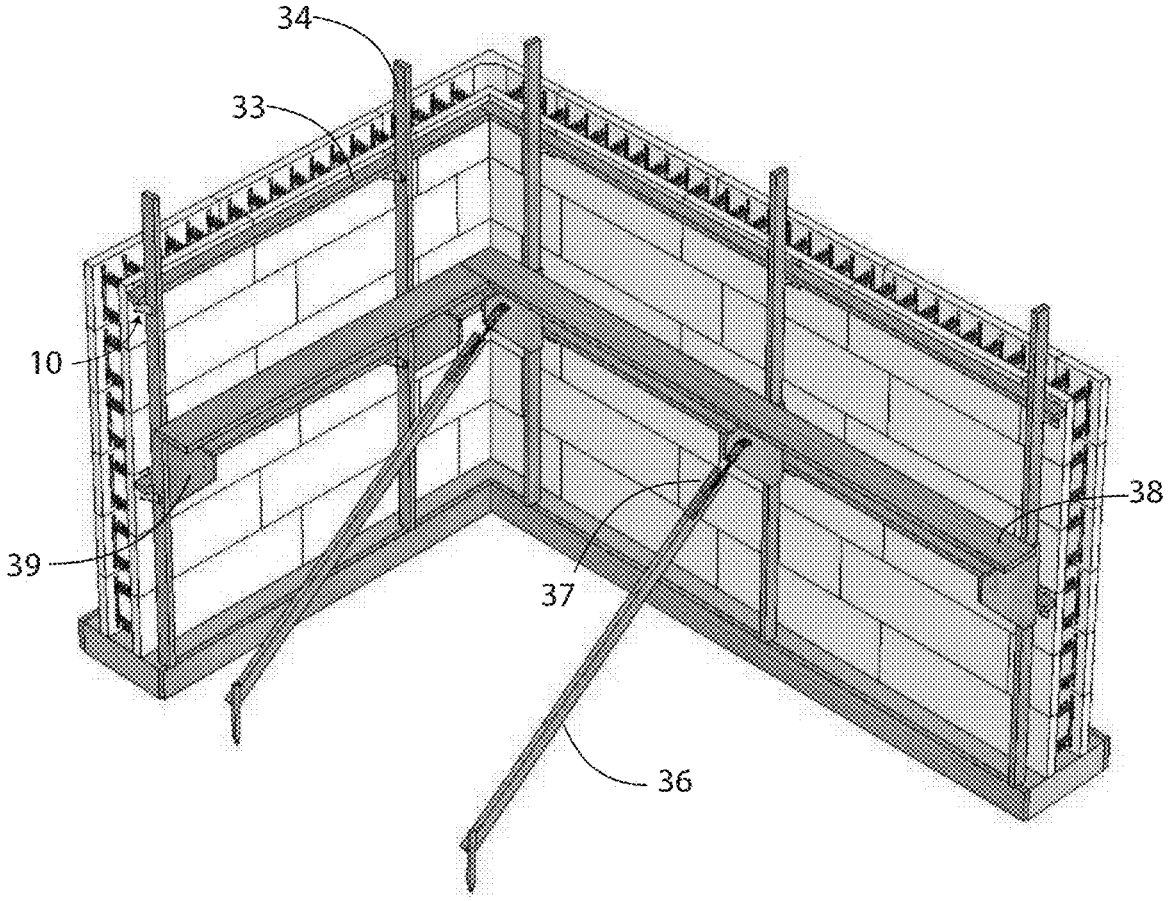
FIG. 8 is a simplified perspective view of a concrete wall aligned with the clamps, walers, strongbacks, kickers and turnbuckles.

FIG. 8 shows a concrete wall with corner showing a typical installation of the bracing system. The clamps (10) are located 6 feet on center around the perimeter with a vertical spacing of 4 to 6 feet. Usually the first clamps are located 4 feet above the footing or slab and the second row of clamps at the top of the wall 8 feet above the footing or slab. The walers are then set on the horizontal surfaces (13) and the strongbacks (34) placed between the cam and waler as shown. Kickers (36) made of 2×4s, with turnbuckles (37) are placed between each strongback and the ground (or floor) to plumb the strongback. Plywood gussets (39) are attached to each strongback allowing a catwalk (38) to be installed so that the top of the wall can be constructed and the concrete poured into the forms.

As the curing of concrete gives off heat during the hydration process, the heat can lead to softening of the foam panels, which in turn can lead to a settlement of the formwork. The direction of the curvature of the surface on the cam (21) is such that as the wall settles, the cam turns counter clockwise and tightens against the strongback and waler. This prevents any loosening of the clamp during and after the concrete pour. Ridges on the surface (21) prevent slippage between the cam and strongback.

The invention claimed is:

1. An alignment clamp for securing horizontal walers and vertical strongbacks to a concrete wall form, said clamp comprising:

a. a singularly formed bracket consisting of three integrated surfaces:

i. a vertical surface attached to said wall form;

ii. an extending horizontal surface in contact with said vertical surface of sufficient length to support said waler;

iii. an extending vertical surface extending at right angle from one vertical edge of said vertical surface and one horizontal edge of said horizontal surface, extension running past said horizontal surface;

b. a rotary cam comprising a cylinder of modified cylindrical shape having a profile of varying radius attached near end of said extending vertical surface not adjacent to said vertical surface, with a cam pivot axis perpendicular to said vertical surface.

2. The alignment clamp of claim 1, wherein said rotary cam includes a flat face adjacent to the rotary cam cylinder end opposite from said extending vertical surface, sharing said cam pivot axis and having a respective radius larger than a radius of said rotary cam.

3. The combination of claim 2, in which at least a portion of said flat face has a radius equal to a radius of the rotary cam.

4. The alignment clamp of claim 1, in which the curved surface of said rotary cam has ridges running parallel to said rotary cam pivot axis.

5. The alignment clamp of claim 1, wherein the radius of said rotary cam increases around the perimeter such that the difference in radius between two points divided by the associated circumference distance between two said radii is between two and seven percent.

6. The alignment clamp of claim 1, wherein the radius of said rotary cam increases in the counter clockwise direction, when viewed from the direction where the rotary cam is not hidden by said extended vertical surface.

7. The alignment clamp of claim 1, wherein the flat face of said rotary cam opposing the extending vertical surface has at least one protrusion extending perpendicular to said face.

* * * * *